United States Patent [19]

Moglianesi et al.

[11] Patent Number: 4,847,936

[45] Date of Patent: Jul. 18, 1989

[54] TOOTHBRUSH

[75] Inventors: Carlos J. Moglianesi, Whittier, Calif.; Mark Falco, Lavallette; Leslie Peoples, Trenton, both of N.J.

[73] Assignee: Contour, Inc., Trenton, N.J.

[21] Appl. No.: 140,762

[22] Filed: Jan. 4, 1988

[51] Int. Cl.[4] ..... A46B 9/04

[52] U.S. Cl. ..... 15/167.1; 15/DIG. 5

[58] Field of Search ..... 15/167.1, 167.2, 172, 15/143 R, 16 D, DIG. 5; D4/104

[56] References Cited

U.S. PATENT DOCUMENTS

| | | | |
|---|---|---|---|
| D. 200,395 | 2/1965 | Brennesholtz | D4/104 |
| D. 209,736 | 1/1968 | Halm | D4/104 |
| D. 238,833 | 2/1976 | Hjelle et al. | D4/104 |
| D. 275,532 | 9/1984 | Solomon | D4/104 |
| D. 276,005 | 10/1984 | Fido | D4/104 |
| 1,188,614 | 6/1916 | Bowen | 15/172 |
| 1,389,624 | 9/1921 | Carroll | 15/167.2 |
| 1,611,640 | 12/1926 | Janus | 15/167.1 |
| 1,984,787 | 12/1934 | Elliot | 15/143 R |
| 2,431,861 | 12/1947 | Babe | 15/167.1 |
| 2,483,503 | 10/1949 | Pollack | 15/167.1 |
| 2,625,697 | 1/1953 | Cyser | 15/167.1 X R |
| 4,356,585 | 11/1982 | Protell et al. | 15/167.1 X R |

FOREIGN PATENT DOCUMENTS

| | | | |
|---|---|---|---|
| 1554605 | 12/1968 | France | 15/167.1 |
| 85401 | 2/1936 | Switzerland | 15/167.1 |

*Primary Examiner*—Peter Feldman

*Attorney, Agent, or Firm*—Shenier & O'Connor

[57] ABSTRACT

A toothbrush in which the bristles define a surface across the width of the handle having a convex portion along the midline of the handle and concave portions on either side of the convex portion, thereby to conform to the corresponding complementary surface portions of the molars. In a preferred embodiment the bristles are longest along the center of the handle and shortest along the sides of the handle. To facilitate gripping, the handle has a cross-section that is concave along the front of the handle and of uniform thickness across the width of the handle. To minimize displacement of the handle when brushing various portions of the teeth, the handle is rearwardly curved along the lower portion thereof and is forwardly curved along the upper portion thereof.

5 Claims, 2 Drawing Sheets

TOOTHBRUSH

BACKGROUND OF THE INVENTION

Toothbrushes conventionally have bristles of equal length, both along and across the face of the handle. Teeth on the other hand geernally have curved surfaces. Owing to this lack of conformity between the bristle contour and that of the teeth, contact pressure, and hence cleaning effectiveness is nonuniform. Such nonuniformity of cleaning is especially problematic in the region of the molars, where food particles tend to become lodged because of the high crushing pressures and where the surfaces cannot readily be inspected to ascertain the extent to which they have been cleaned. In addition to these deficiencies related to cleaning effectiveness, toothbrushes of the prior art generally have handles of rectangular cross-section and, as a result, are difficult to grip.

Various toothbrushes of the prior art have specially shaped bristles for facilitating the cleaning of various parts of the teeth and adjacent gums, as well as specially designed handles for improved grip. Such toothbrushes are shown, for example, in Davenport U.S. Pat. No. 803,995, Kuzzer U.S. Pat. No. 890,143, Malcolm U.S. Pat. No. 2,043,898, Olson U.S. Pat. No. 2,797,424, Smith U.S. Pat No. 3,792,504, Kim U.S. Pat. No. 3,934,298, Warren et al U.S. Pat. No. 4,033,008, Booth U.S. Pat. No. 4,330,896 and Rauch U.S. Pat. No. 4,610,045. None of these toothbrushes, however, have completely solved the problems referred to above.

SUMMARY OF THE INVENTION

One of the objects of our invention is to provide a toothbrush which effectively cleans the surfaces of the teeth on which it is used.

Another object of our invention is to provide a toothbrush which is effective in removing plaque.

Still another object of our invention is to provide a toothbrush which is especially effective in cleaning molars.

A further object of our invention is to provide a toothbrush which is easy to grip.

Other and further objects will be apparent from the description that follows.

In general, our invention contemplates a toothbrush in which the bristles define a surface across the width of the handle having a convex portion along the midline of the handle and concave portions on either side of the convex portion, thereby to conform to the corresponding complementary surface portions of the molars. In a preferred embodiment the bristles are longest along the center of the handle and shortest along the sides of the handle. In another aspect of our invention, the handle has a cross-section that is concave along the front of the handle of uniform thickness across the width of the handle to improve gripping. In yet another aspect of our invention, our handle is rearwardly curved along its lower portion and forwardly curved along it upper portion to minimize displacement of the handle when brushing different parts of the teeth.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENTS

Figure 1:
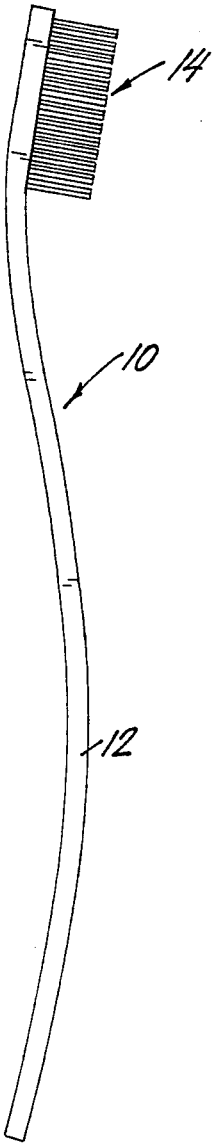
FIG. 1 is a left side elevation of one embodiment of a toothbrush incorporating our invention.
Figure 2:
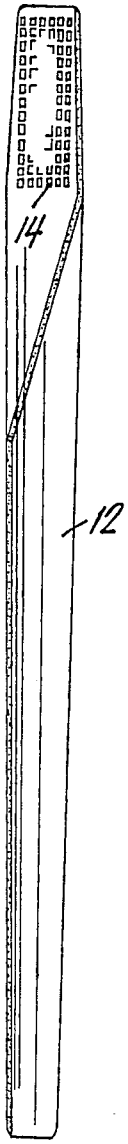
FIG. 2 is a front elevation of the toothbrush shown in FIG. 1.
Figure 3:
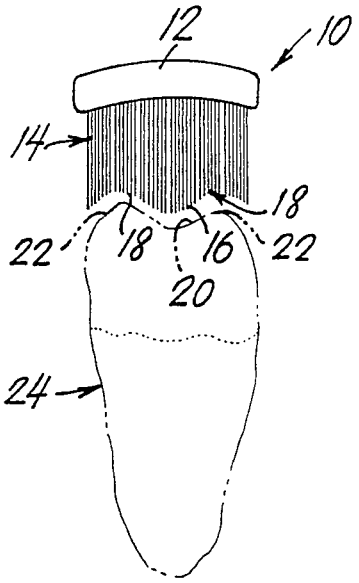
FIG. 3 is an enlarged top plan of the toothbrush shown in FIG. 1, illustrating the relationship between the contours of the bristle surfaces and those of a typical molar.
Figure 4:
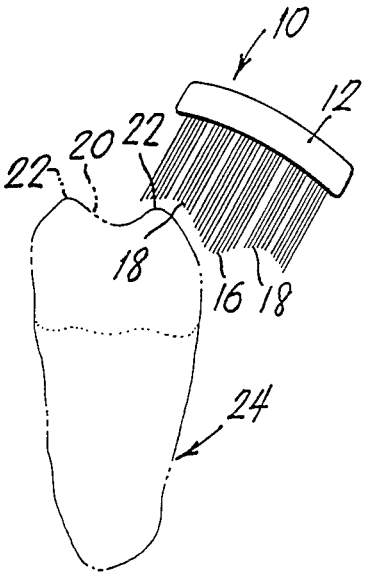
FIG. 4 is an enlarged top plan of the toothbrush of FIG. 1 in a moved position on the same molar.
Figure 5:
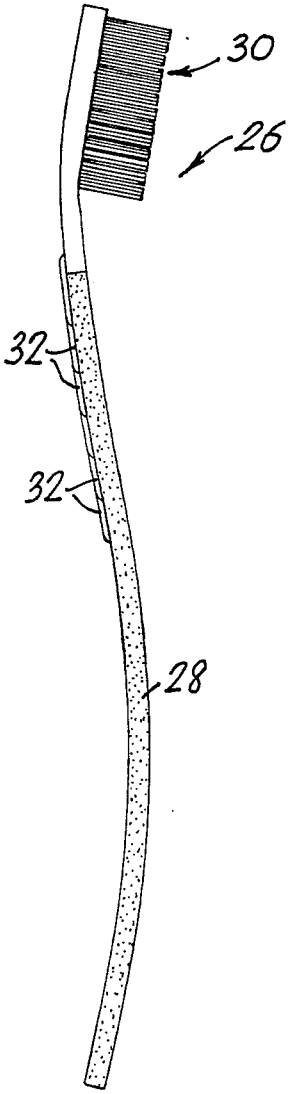
FIG. 5 is a left side elevation of an alternative embodiment of our invention.

Referring first to FIGS. 1 to 4, a first embodiment of our invention, indicated generally by the reference numeral 10, includes a handle 12 that is generally S-shaped along its length. Brush 10 is 18 cm long and 12 mm wide at the head, shown at the top of FIGS. 1 and 2. As shown in FIG. 2, the toothbrush 10 includes six longitudinal rows of tufts of bristles 14, each row comprising thirteen tufts and the tufts in each row being aligned with the tufts in adjacent rows. Handle 12 curves in the direction of the bristles 14 along the upper portion of its length while curving away from the bristles 14 along the lower portion of its length as shown in FIG. 1. This minimizes displacement of the handle when brushing different parts of the teeth. As shown in FIGS. 3 and 4, the handle 12 also has a curved cross-section of constant thickness across the handle, with the bristles 14 on the concave side of the curve.

In accordance with a principal feature of our invention, the length of the bristles 14 varies sinusoidally across the width of the brush so as to create a longitudinally extending central region or crest 16, in which the bristles 14 are longest and their ends define a convex curve, as well as two lateral regions or troughs 18 in which the bristles 14 are shorter and their ends define a concave curve. The bristles 14 at any one location across the width of handle 12, however, are of constant length from one end to the other. Bristles 14 extend 14 mm from the rear of handle 12 along the crest 16 and are about 3 mm shorter along the middle of each trough 18. The bristles 14 extending along the sides of the brush 10, though longer than those along the middle of the troughs 18, are nevertheless shorter than those along the crest 16. Preferably the curve defined by the bristles 14 has a maximum slope of 50°.

As shown in FIG. 3, when the brush 10 is placed squarely on top of a typical molar, indicated general by the reference numeral 24, the convex portion 16 of the bristle contour conforms readily to the concave portion 20 of the crown of the molar 24, while the concave portions 18 conform to the convex molar portions 22 on either side of the concave portion 20. As a result, contact pressure between the bristles 14 and the molar 24 is substantially uniform across the top of the crown, resulting in a substantial improvement in cleaning effectiveness. As shown in FIG. 4, if the toothbrush 10 is moved to clean an upper side portion of the crown of molar 24, the concave bristle portion 18 continues to conform substantially to the adjacent convex surface portion 22 of the molar. Thus, toothbrush 10 may be moved about the top of the molar 24, as shown in FIGS. 3 and 4, to effectively clean the molar, both on the top and along the upper side portions thereof.

To clean the sides of the molar 24 and along the gumline (indicated by the dotted lines across the surface of the molar 24 in FIGS. 3 and 4), the brush 10 is held at a 45° angle and the crest 16 placed against the gumline. In this position, not only does the crest 16 massage the gumline, removing any food particles that may have become lodged between the molar 24 and the adjacent gum, but the concave portion of trough 18 on one side of the brush 10 continues to conform to the side of the molar, providing cleaning action in this region as well.

Figure 6:
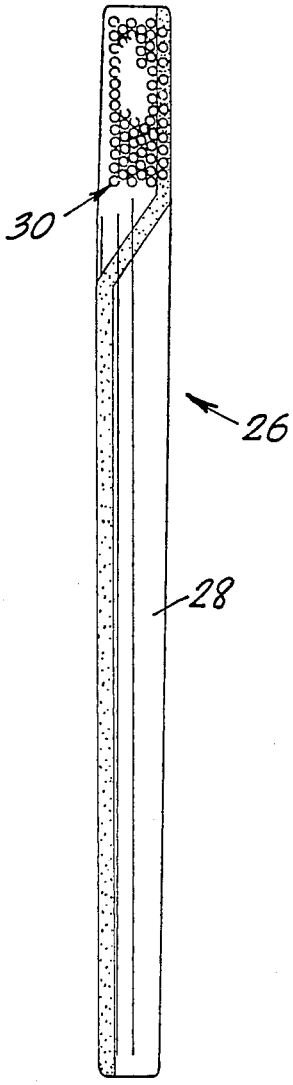
FIG. 6 is a front elevation of the toothbrush shown in FIG. 5.
Figure 7:
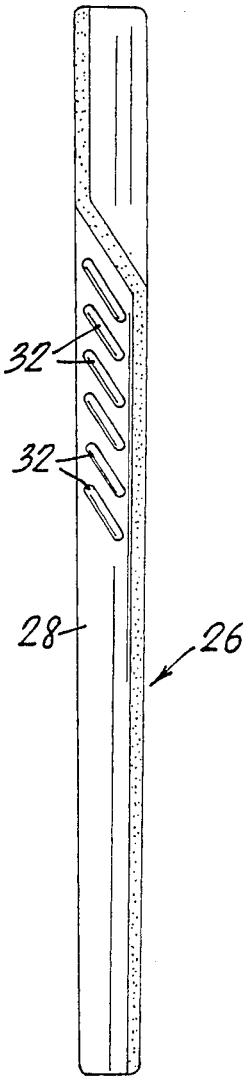
FIG. 7 is a rear elevation of the toothbrush shown in FIG. 5.
Figure 8:
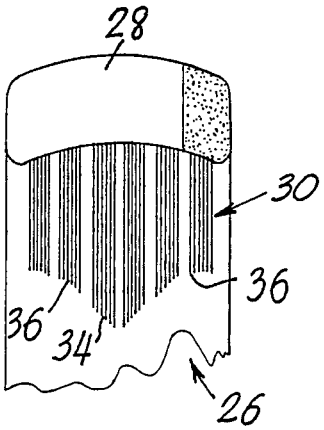
FIG. 8 is an enlarged top plan of the toothbrush shown in FIG. 5.
Figure 9:
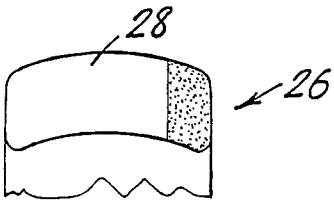
FIG. 9 is an enlarged bottom plan of the toothbrush shown in FIG. 5.

Referring now to FIGS. 5 to 9, a preferred embodiment of our invention is indicated generally by the reference numeral 26. Toothbrush 26 is generally similar to the brush 10 shown in FIGS. 1 to 4, but includes a handle 28 formed with diagonally extending raised surface portions 32 on the back thereof to improve the grip of the user. Brush 26 is 17.5 cm long, 10 mm wide at the lower end of handle 28, 13 mm wide at the upper end of handle 28 and 5.5 mm thick at the upper handle end. As shown in FIG. 6, the head of handle 28 carries six longitudinal rows of bristle tufts, each row of which consists of twelve or thirteen tufts and is staggered relative to adjacent rows. Referring now to FIG. 8, in contrast to the embodiment of FIG. 4, in which the bristles 14 are shortest in the region of the second and fifth rows of bristles, the bristles 30 of the preferred embodiment are shortest along their side edges. However, like the bristles 14 of the first embodiment, bristles 30 define a contour consisting of a convex portion 34 or crest of maximal length extending along the midline of the handle 28 and concave portions 36 on either side of the convex portion 34. Bristles 30 extend 15 mm from the rear of handle 28 along the crest 34 and are 3.5 mm shorter along the sides. Preferably the ends of bristles 30 define a surface having a maximum slope of 50° relative to the horizontal so as to form a dihedral angle of 80° along the crest 34. Shaping the edges of the bristles in this manner improves the ability of the bristles 30 to contact more planar portions of the teeth, especially when used along the gumline at a 45° angle as described above for brush 10.

It will be seen that we have accomplished the objects of our invention. Our toothbrush effectively cleans the surfaces of the teeth on which it is used, and is especially effective in cleaning molars. Our toothbrush is also extremely effective in removing plaque. Further, our toothbrush is easy to grip.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A toothbrush comprising an elongated handle having a head carrying a plurality of bristles at one end thereof, said head being elongated in the direction of the length of said handle, the ends of said bristles defining a surface across the width of said head having a convex portion along the center of said head and concave portions on either side of said convex portion.

2. A toothbrush as in claim 1 in which said bristles are longest along the center of said handle and shortest along the sides of said handle.

3. A toothbrush as in claim 1 in which the length of said bristles varies substantially sinusoidally across the width of said handle.

4. A toothbrush as in claim 1 in which said surface has a maximum slope of about 50°.

5. A toothbrush as in claim 1 in which the bristles at any one location across the width of said head are of constant length along said head.

* * * * *